US007563045B2

(12) United States Patent
Nagata

(10) Patent No.: US 7,563,045 B2
(45) Date of Patent: Jul. 21, 2009

(54) ROLL PAPER PRINTER

(75) Inventor: Norio Nagata, Matsumoto (JP)

(73) Assignee: Seiko Epson Corporation (JP)

( * ) Notice: Subject to any disclaimer, the term of this patent is extended or adjusted under 35 U.S.C. 154(b) by 279 days.

(21) Appl. No.: 11/524,846

(22) Filed: Sep. 20, 2006

(65) Prior Publication Data

US 2007/0065222 A1 Mar. 22, 2007

(30) Foreign Application Priority Data

Sep. 21, 2005 (JP) ..... 2005-273411

(51) Int. Cl.
*B41J 29/02* (2006.01)

(52) U.S. Cl. ..... 400/693; 400/692

(58) Field of Classification Search ..... 400/693, 400/692

See application file for complete search history.

(56) References Cited

U.S. PATENT DOCUMENTS

| | | | | |
|---|---|---|---|---|
| 3,499,517 | A * | 3/1970 | Cappotto | 400/693.1 |
| 4,847,632 | A * | 7/1989 | Norris | 346/134 |
| 5,053,820 | A * | 10/1991 | Preszler et al. | 399/119 |
| 5,528,278 | A * | 6/1996 | Takizawa et al. | 347/218 |
| 6,474,883 | B1 | 11/2002 | Kawakami et al. | |

FOREIGN PATENT DOCUMENTS

| | | |
|---|---|---|
| JP | 05-201359 | 8/1993 |
| JP | 2001-063373 | 3/2001 |
| JP | 2001-158141 | 6/2001 |
| JP | 2001-158142 | 6/2001 |
| JP | 2001-213552 | 8/2001 |
| JP | 2001-341903 | 12/2001 |
| JP | 2002-308482 | 10/2002 |

* cited by examiner

*Primary Examiner*—Anthony H. Nguyen
(74) *Attorney, Agent, or Firm*—Baker & Hostetler, LLP

(57) ABSTRACT

A printer having a cover opening and closing mechanism for opening and closing a cover to the roll paper compartment of the printer including a four-node parallel linkage mechanism and an urging member to prevent the four-node parallel linkage mechanism from locking into a fixed position when the cover is opened or closed. The four-node parallel linkage mechanism comprises right and left side panel portions of a rocker panel to which the cover is attached, right and left rocker arms located behind the rocker panel, and a parallel motion panel disposed horizontally connecting the top ends of the rocker panel and the rocker arms. A coil spring pulls up on the rocker arms when the cover opening and closing mechanism is swung down to the horizontal full open position, and a flexible strip between the rocker arms and parallel motion panel pushes up on the parallel motion panel. The parallel motion panel and the rocker arms are thus prevented from bending downward at the node where they join, and the parallel linkage mechanism is therefore prevented from locking.

9 Claims, 8 Drawing Sheets

ROLL PAPER PRINTER

BACKGROUND OF THE INVENTION

1. Field of Technology

The present invention relates to a roll paper printer including an opening and closing mechanism having a four-node parallel linkage mechanism for opening and closing the cover to the roll paper compartment in the printer.

2. Description of Related Art

Roll paper printers having a four-node parallel linkage mechanism for opening and closing the cover to a roll paper compartment rendered inside the printer are known from the literature. JP-A-2001-341903 (corresponding to U.S. Pat. No. 6,474,883 and Chinese Patent ZL00131858.6) and JP-A-2002-308482, for example, teach roll paper printers wherein a cover attached to the front of a housing for storing the roll paper is opened to the front of the printer by means of a parallel linkage mechanism. The attitude of the links in this parallel linkage mechanism does not change as the links move forward and back in conjunction with opening and closing the cover. This parallel linkage mechanism therefore requires less space for the opening and closing mechanism to move than a cover opening and closing mechanism that draws a circular arc when opening and closing.

The cover preferably opens wide in order to provide easier access for loading and replacing the roll paper. As shown schematically in FIG. 9A to FIG. 9C, the front and back rocker links 101, 102 of the parallel linkage mechanism 100 swing forward and down when the cover 110, which is supported to open and close by means of a four-node parallel linkage mechanism 100, is opened to the front from the upright closed position shown in FIG. 9A. When the cover 110 opens to the horizontal position, the front and back rocker links 101, 102 and the parallel movement link 103 connecting the top ends of the front and back rocker links 101, 102 are folded together horizontally (into a collapsed position corresponding to the open position of the cover) as shown in FIG. 9B. When the cover 110 is then raised from this open position to the closed position, the parallel movement link 103 and the back rocker link 102 can bend at node 104 into a shallow downward pointing V-shape (see FIG. 9C) causing the parallel linkage mechanism 100 to lock and become inoperable.

In order to prevent the parallel linkage mechanism 100 from locking, the open angle of the cover 110 must be reduced and limited so that when the cover 110 is completely open the four nodes 104 to 107 of the parallel linkage mechanism 100 describe the four corners of a parallelogram. This arrangement, however, reduces the vertical height of the opening to the roll paper compartment when the cover is open, and therefore hinders loading and replacing the roll paper.

SUMMARY OF THE INVENTION

The present invention is directed to solving this problem and provides a roll paper printer having a four-node parallel linkage mechanism for opening and closing the roll paper compartment cover arranged so that the four-node parallel linkage mechanism does not lock even when the roll paper compartment cover is opened widely.

A roll paper printer according to a preferred aspect of the invention comprises a roll paper compartment; a cover for the roll paper compartment; and an cover opening and closing mechanism for opening and closing the cover. The cover opening and closing mechanism comprises a four-node parallel linkage mechanism, and a linkage urging member for urging the parallel linkage mechanism toward a given opening or closing direction of the cover so that the parallel linkage mechanism will not lock.

When the cover is opened to where the four-node parallel linkage mechanism is in a straight line, the urging force of the linkage urging member in the cover opening and closing mechanism of this roll paper printer prevents the second rocker link and the parallel motion link of the parallel linkage mechanism from folding down around the node between the links. As a result, the cover can be swung open to a substantially horizontal position and the roll paper compartment can be opened widely.

Preferably, the parallel linkage mechanism comprises a first rocker link and a second rocker link that can pivot on the bottom end portions in the opening and closing direction of the cover, and a parallel motion link connecting top end portions of the first and second rocker links. The second rocker link is located on the side of the first rocker link facing the direction in which the cover closes, and the linkage urging member is a spring member urging the second rocker link in the cover closing direction pivoting on a node defining a pivot axis at a bottom end portion of the second rocker link.

Because the spring member constantly urges the second rocker link in the direction in which the cover closes, the second rocker link is prevented from swinging in the opposite direction and locking the parallel linkage mechanism when the cover is closed.

Further preferably, the roll paper compartment comprises a roll paper holder for holding roll paper so that the roll paper can roll. The roll paper holder can incline in the opening direction of the cover so that the roll paper holder is inclined when the cover is open, and the roll paper holder is upright when the cover is closed. The spring member is an extension spring constantly applying tension so that the roll paper holder does not incline (and more specifically is an extension spring that constantly pulls the roll paper holder in the direction from the inclined position to the upright position). An engaging portion is formed to the roll paper holder so that the engaging portion engages and is held engaged with the second rocker link after the second rocker link swings a predetermined distance in the cover opening direction.

Because the urging force of the spring acts on the second rocker link when the cover is open, the parallel linkage mechanism can be prevented from locking when the cover is closed. In addition, when the cover opens, the second rocker link swings in conjunction with the cover and causes the roll paper holder to incline. This causes the roll paper resting on the roll paper holder to roll towards the cover, and thus facilitates replacing the roll paper.

Alternatively or in conjunction with the spring member the linkage urging member may be an elastic member that is disposed between the first rocker link and the parallel motion link when the cover is opened to the full open position. This elastic member pushes up on the parallel motion link when the cover is in the full open position. When the cover is then closed from this full open position, the parallel motion link is prevented from swinging down around the node at the front end thereof, and the four-node parallel linkage mechanism is thus prevented from locking.

Preferably, the first rocker link comprises a pair of arms disposed at opposite sides of the roll paper compartment, and a connecting member linking the pair of arms. The cover is affixed on the side of the connecting member in the cover opening direction, and the elastic member is placed on the side of the connecting member in the cover closing direction. The cover, elastic member, and first rocker link can therefore be positioned efficiently.

The cover opening and closing mechanism in a roll paper printer according to the present invention comprises a four-node parallel linkage mechanism and a linkage urging member arranged such that the parallel linkage mechanism does not lock when it is raised from the down position. As a result, the parallel linkage mechanism is prevented from locking when the cover is closed even if the links of the parallel linkage mechanism supporting the cover fold together in a straight line in order to open the cover wide. The present invention thus provides a roll paper printer having a cover opening and closing mechanism for opening a cover widely by using a four-node parallel linkage mechanism.

Other advantages of the present invention will become apparent and appreciated by referring to the following description and claims taken in conjunction with the accompanying drawings.

DESCRIPTION OF THE PREFERRED EMBODIMENTS

A preferred embodiment of the present invention is described below with reference to the accompanying figures.

General Arrangement

Figure 1:
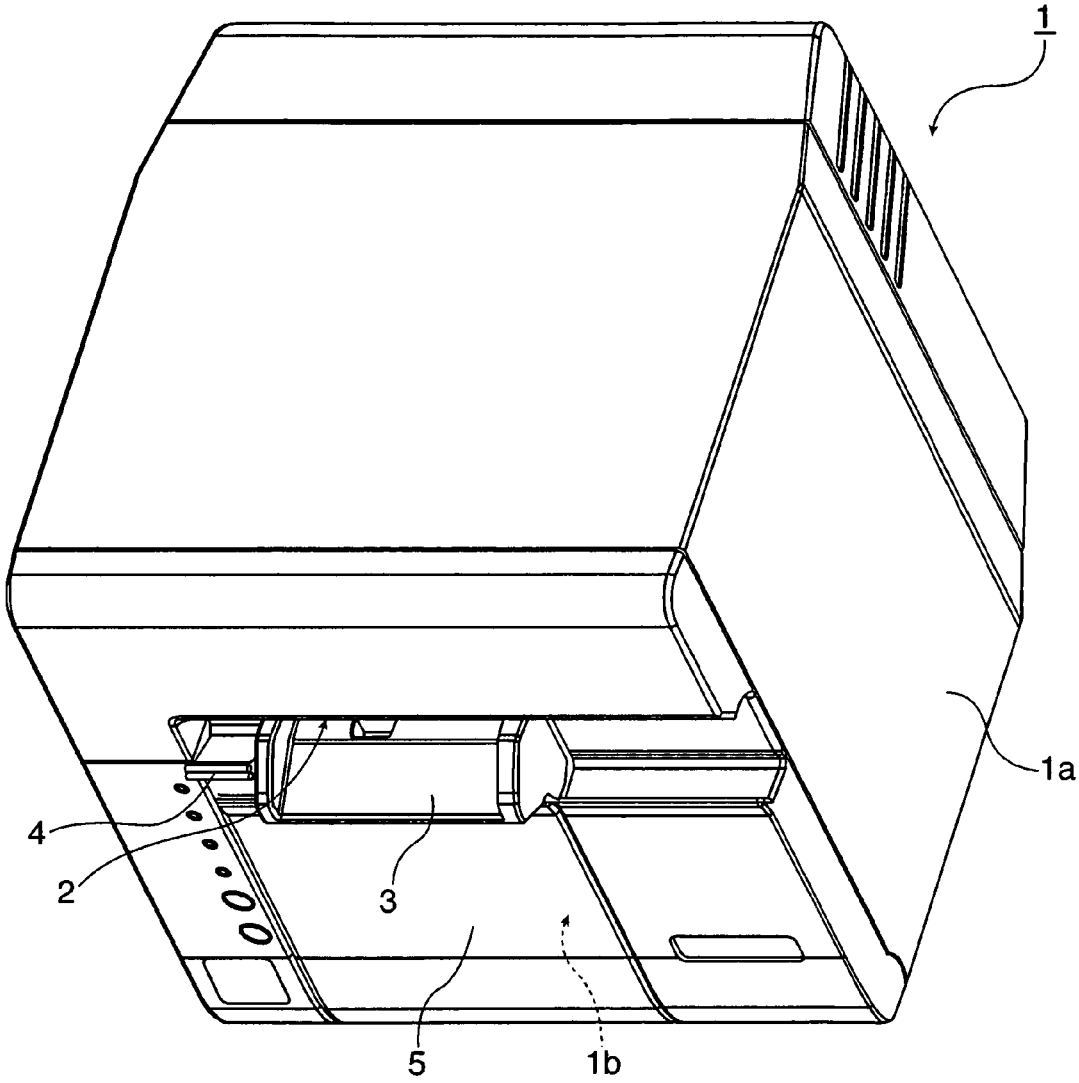
FIG. 1 is an external oblique view of a roll paper printer according to the present invention.

FIG. 1 is an external oblique view of a roll paper printer 1 according to a preferred embodiment of the invention. The roll paper printer 1 has a basically box-shaped external case 1*a* with a paper exit 2 of a specific width formed at the front of the case 1*a*. A paper discharge guide 3 projects from below the paper exit 2 to the front of the printer, and a cover opening lever 4 is located beside the paper discharge guide 3. A rectangular opening 1*b* is rendered in the case 1*a* below the paper discharge guide 3 and cover opening lever 4, and this opening 1*b* is covered by a cover 5 that opens to the front. When the cover opening lever 4 is operated to release a cover locking mechanism not shown and the paper discharge guide 3 is then pulled forward, the cover 5 swings forward and open to a substantially horizontal position pivoting on the bottom end portion of the cover 5.

Figure 2:
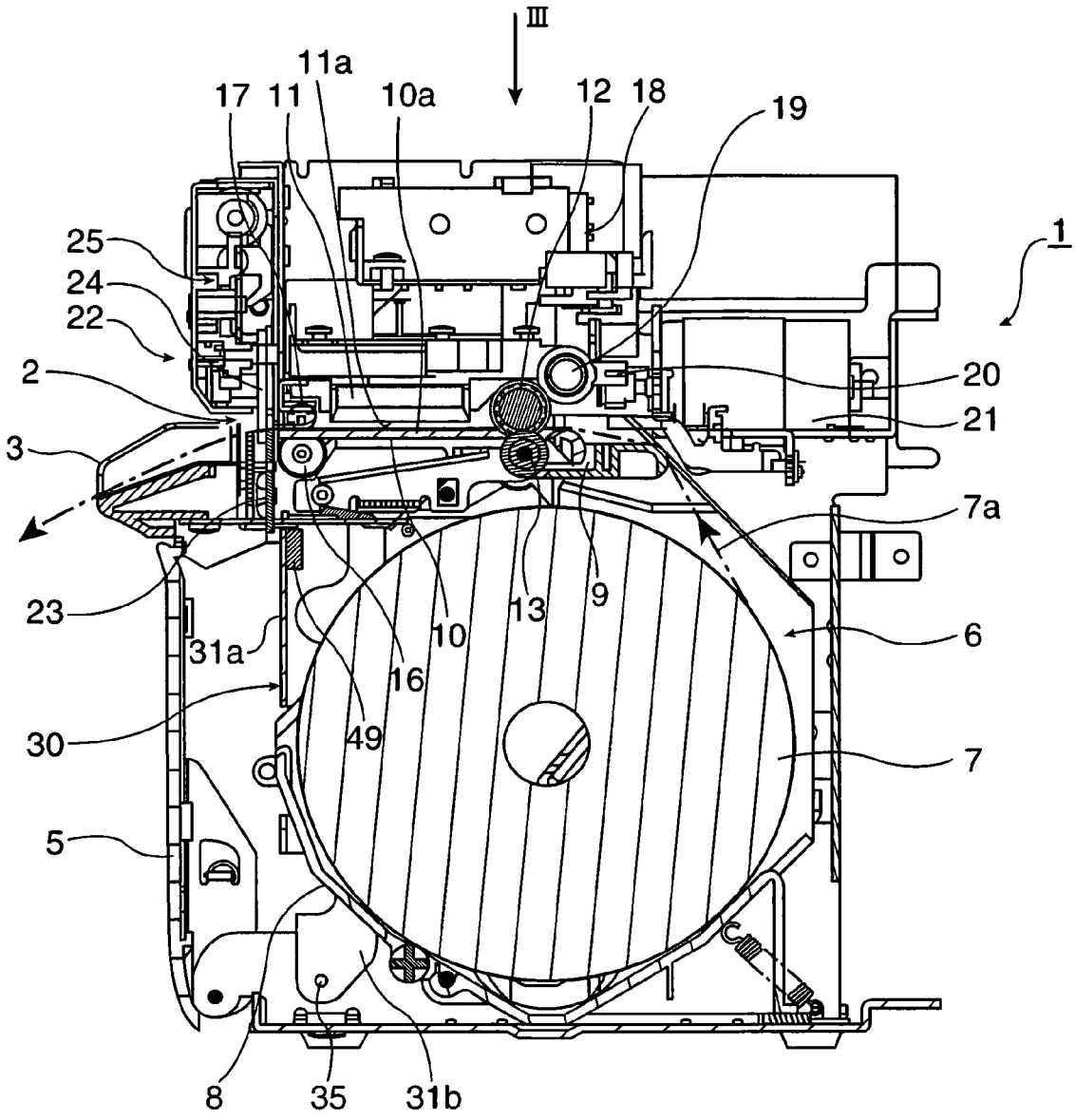
FIG. 2 is a vertical section view showing the internal arrangement of the roll paper printer.
Figure 3:
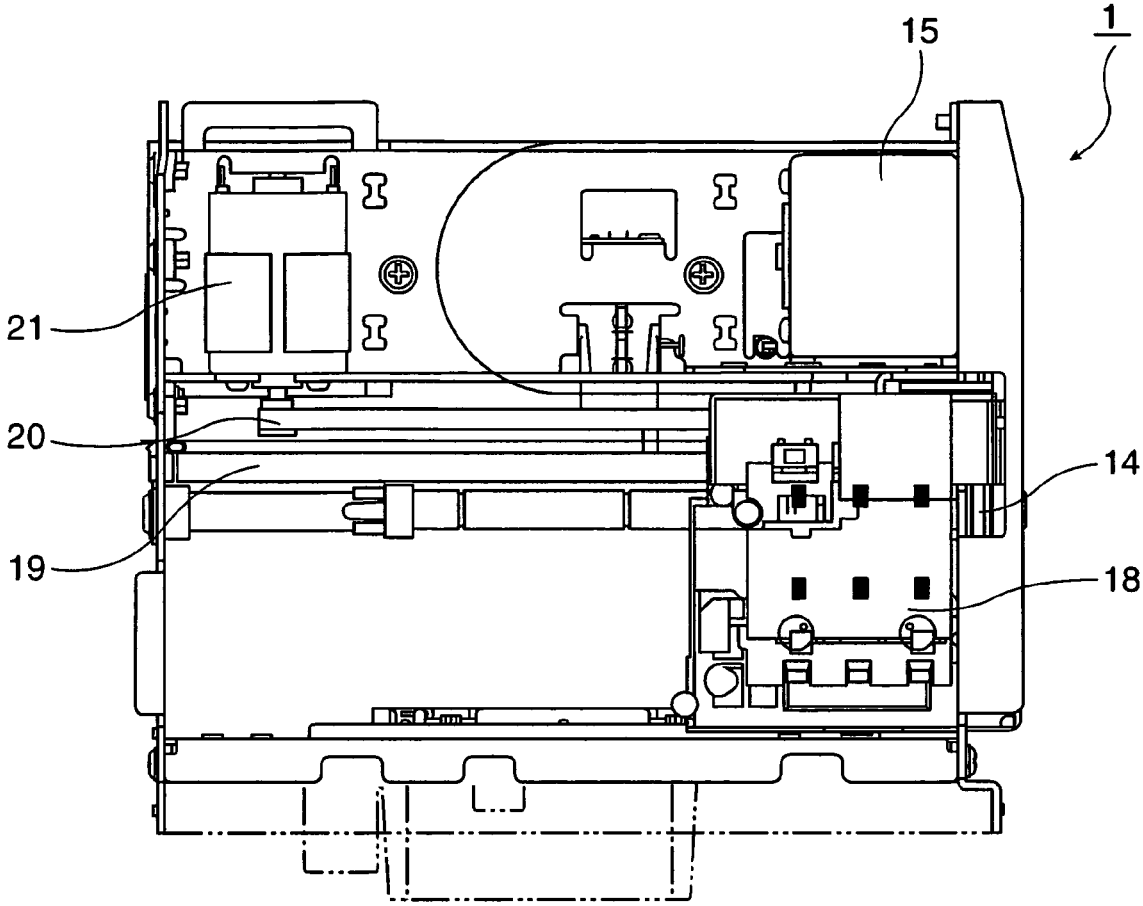
FIG. 3 is a plan view of the roll paper printer as seen through line III in FIG. 2.

FIG. 2 is a vertical section view showing the internal arrangement of the roll paper printer 1 with the case 1*a* removed. FIG. 3 is a plan view of the roll paper printer 1 through line III shown in FIG. 2. As shown in FIG. 2, a roll paper compartment 6 is formed inside the printer so that opening the cover 5 opens the roll paper compartment 6 so that the paper roll 7 can be loaded or replaced from the front of the printer. The cover 5 is attached to a cover opening and closing mechanism 30 comprising a four-node parallel linkage mechanism as further described below, and can open and close pivoting on the bottom end portion of the cover 5.

The roll paper compartment 6 has a roll paper holder 8 for rotatably supporting the paper roll 7. A paper guide 9 having a predetermined width in the front-to-back direction of the printer is disposed horizontally above the roll paper compartment 6 and towards the back of the printer. A platen guide 10 with a predetermined width in the front-to-back direction of the printer is disposed horizontally in front of and at a higher position than the paper guide 9. An inkjet head 11 is located directly above the platen guide 10 with a predetermined gap between the nozzle face 11*a* of the inkjet head 11 and the opposing top surface 10*a* of the platen guide 10. The top surface 10*a* of the platen guide 10 determines the printing position.

A first paper transportation roller 12 is disposed horizontally widthwise to the printer between the platen guide 10 and paper guide 9. A first pressure roller 13 of a predetermined width is pressed against the first paper transportation roller 12 from below with predetermined pressure. The first paper transportation roller 12 is driven by a paper transportation motor 15 by means of a belt and pulley transfer mechanism 14 (see FIG. 3). A second paper transportation roller 16 is located near the front end of the platen guide 10. A second pressure roller 17 is pressed against the second paper transportation roller 16 from above with predetermined pressure.

As shown in FIG. 3, the inkjet head 11 is mounted on a carriage 18, and the carriage 18 is supported movably widthwise to the printer along a carriage guide 19 that extends horizontally widthwise to the printer. The carriage 18 is linked to a timing belt 20 that travels widthwise to the printer, and the timing belt 20 is driven by a carriage motor 21. The inkjet head 11 mounted on the carriage 18 moves widthwise to the printer when the carriage motor 21 is driven, and by driving the inkjet head 11 synchronized to this horizontal movement the recording paper 7*a* delivered from the paper roll 7 is printed as the recording paper 7*a* passes the printing position.

A scissor-type paper cutting device 22 is rendered at the paper exit 2 as also shown in FIG. 2. The fixed blade 23 of this paper cutting device 22 is positioned vertically with the cutting edge facing up, and the moving blade 24 is positioned vertically with the cutting edge facing down. The moving blade 24 pivots at one end thereof and is moved reciprocally up and down by a moving blade drive mechanism 25. When the moving blade 24 pivots down, the point of contact with the fixed blade 23 travels widthwise to the printer and thus cuts the recording paper 7*a* positioned between the fixed blade 23 and moving blade 24 widthwise to the printer.

In a roll paper printer 1 thus comprised the recording paper 7*a* pulled off the paper roll 7 stored in the roll paper compartment 6 is guided by the paper guide 9 to pass between the first paper transportation roller 12 and first pressure roller 13, over the top surface 10*a* of the platen guide 10 (the printing position), between the second paper transportation roller 16 and second pressure roller 17, and outside the printer from the paper exit 2 as indicated by the bold dot-dash line in FIG. 2.

Transportation of the recording paper 7*a* begins when the recording paper 7*a* is thus loaded and the first paper transportation roller 12 and second paper transportation roller 16 rotate. The inkjet head 11 is then driven synchronized to recording paper 7*a* transportation to print to the surface of the recording paper 7*a* at the printing position. When transportation stops with the printed recording paper 7*a* discharged from the paper exit 2, the paper cutting device 22 cuts the recording paper 7*a* and the severed portion of the recording paper 7*a* can be issued as a sales receipt, for example.

Cover Opening and Closing Mechanism

Figure 4:
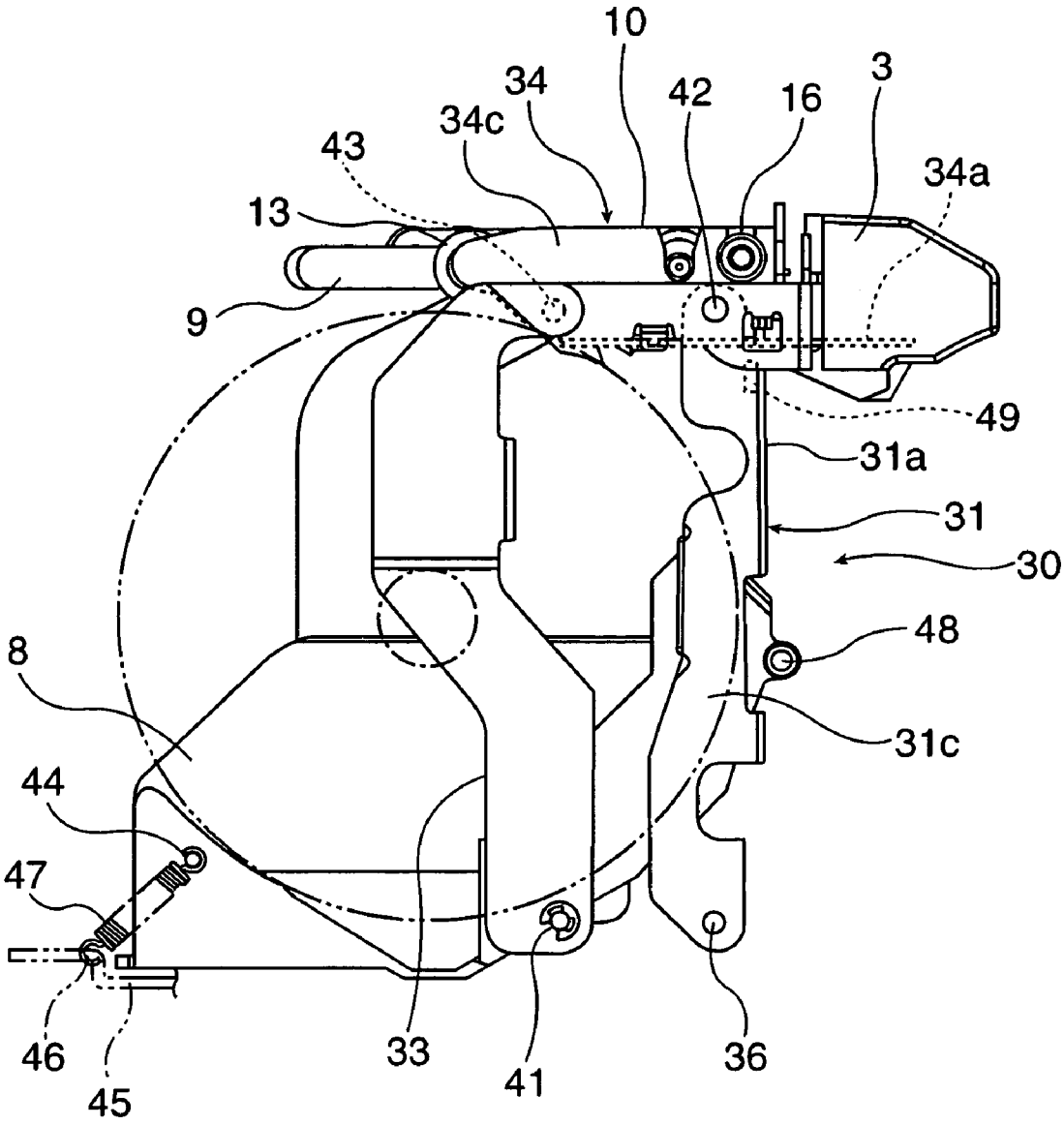
FIG. 4 is a side view of the cover opening and closing mechanism.
Figure 5:
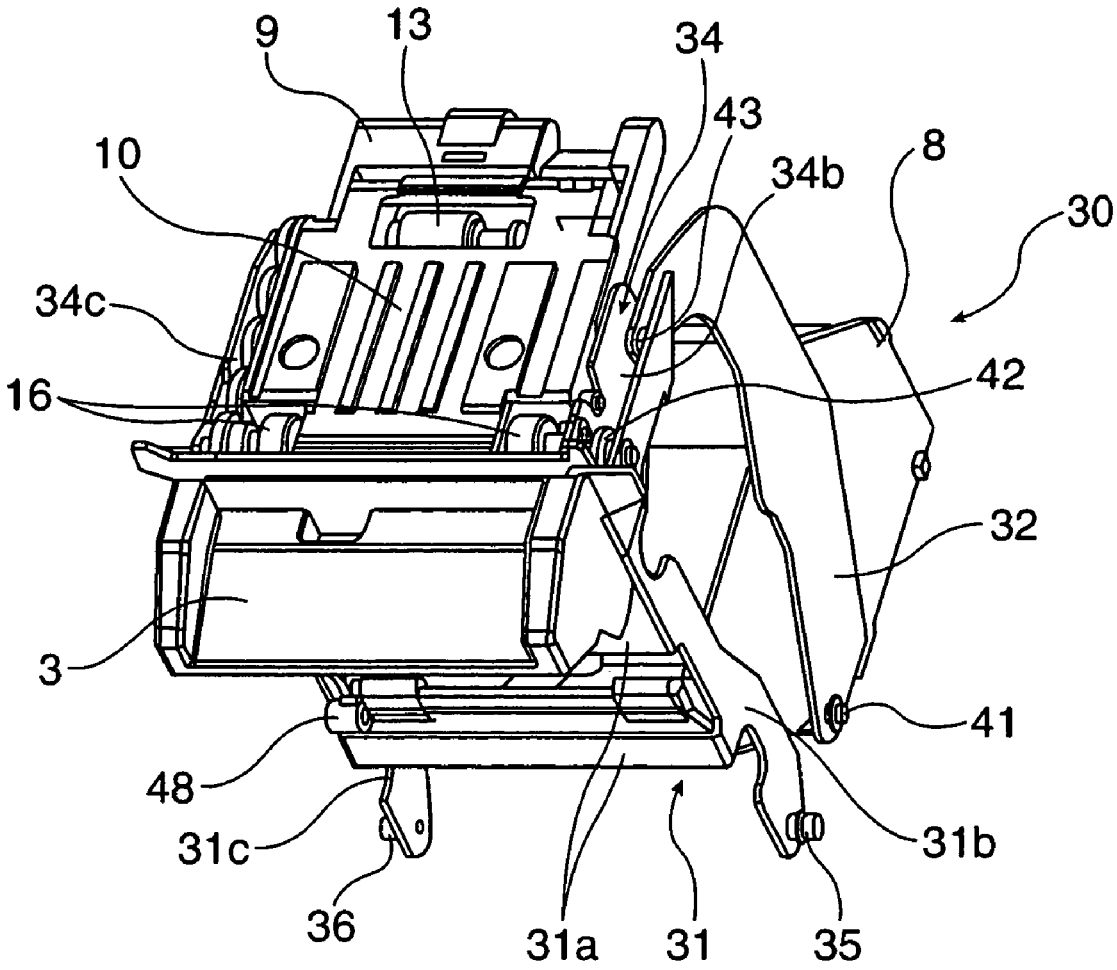
FIG. 5 is an oblique view of the cover opening and closing mechanism.
Figure 6:
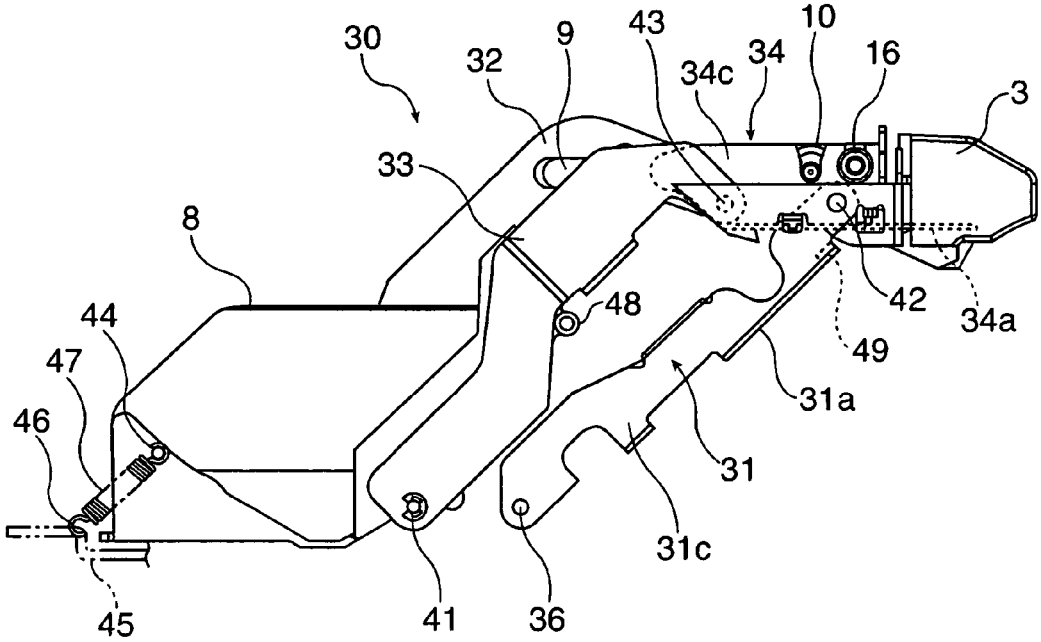
FIG. 6 is a side view of the cover opening and closing mechanism when the cover is open approximately 45 degrees.
Figure 7:
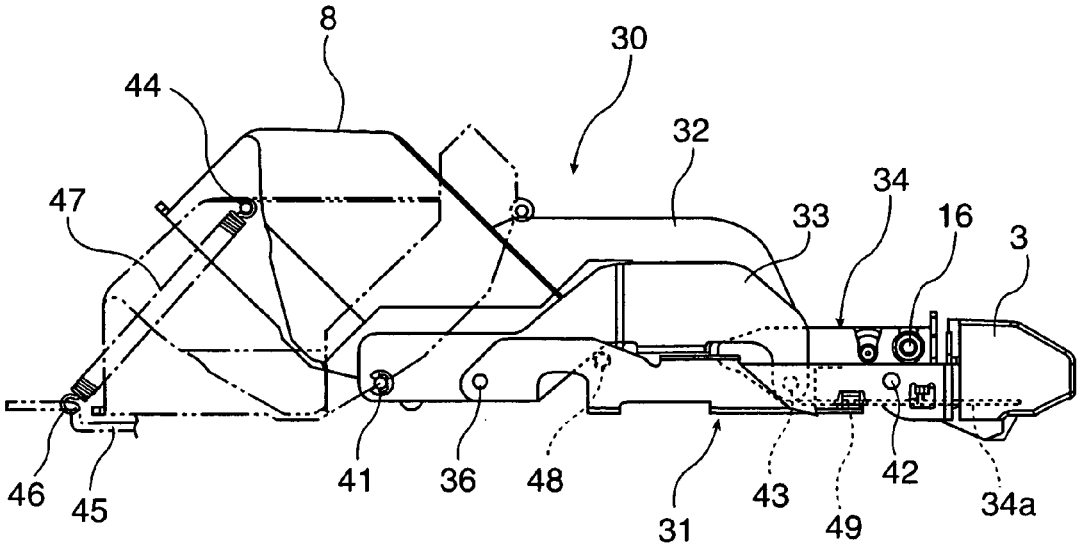
FIG. 7 is a side view of the cover opening and closing mechanism when the cover is in the full open position.
Figure 8:
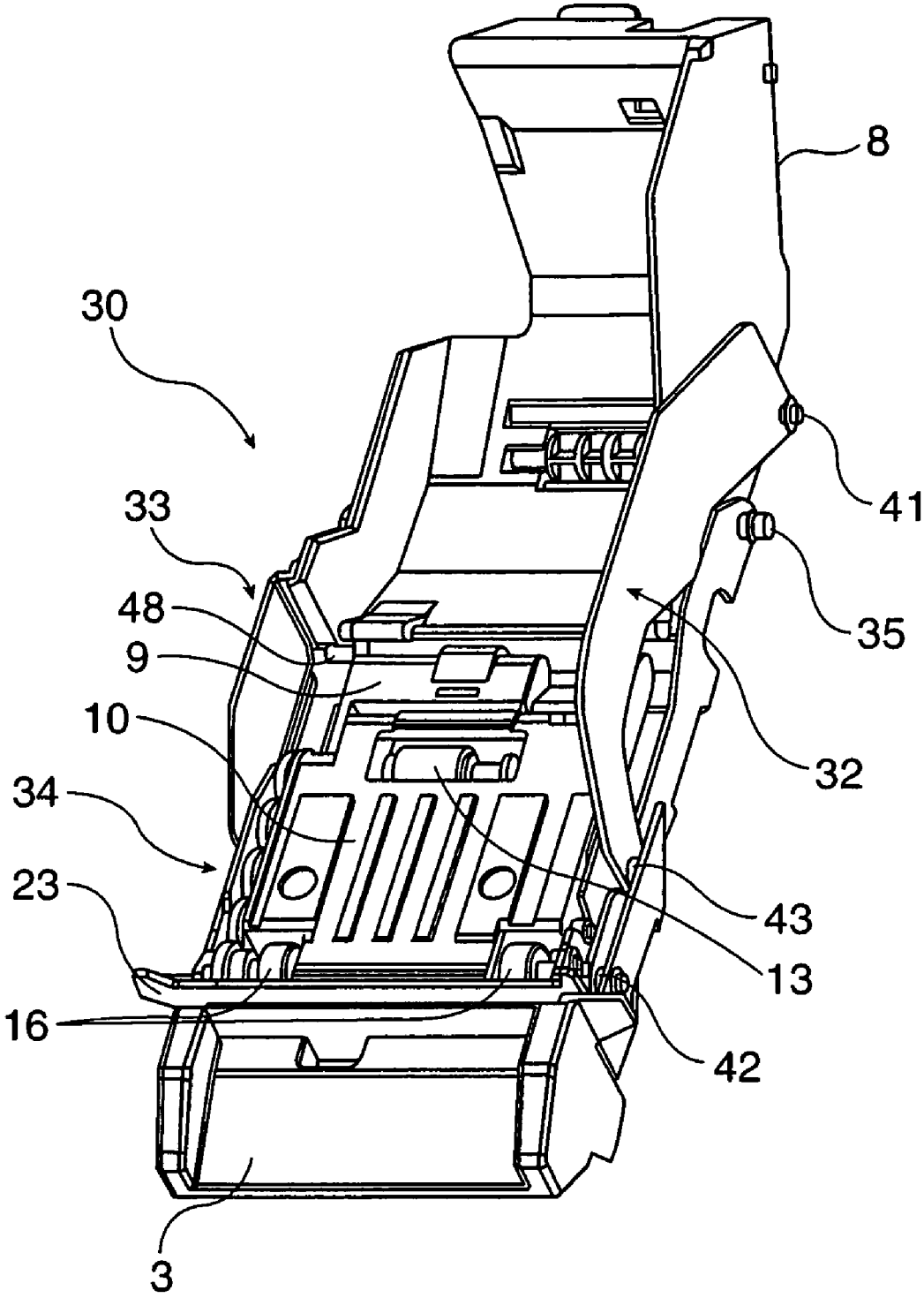
FIG. 8 is an oblique view of the cover opening and closing mechanism when the cover is in the full open position.
Figure 9A:
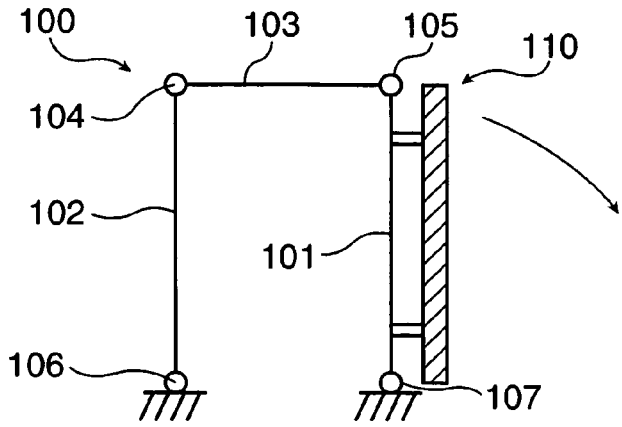
FIG. 9 describes how a cover opening and closing mechanism comprising a four-node parallel linkage mechanism locks.
Figure 9B:
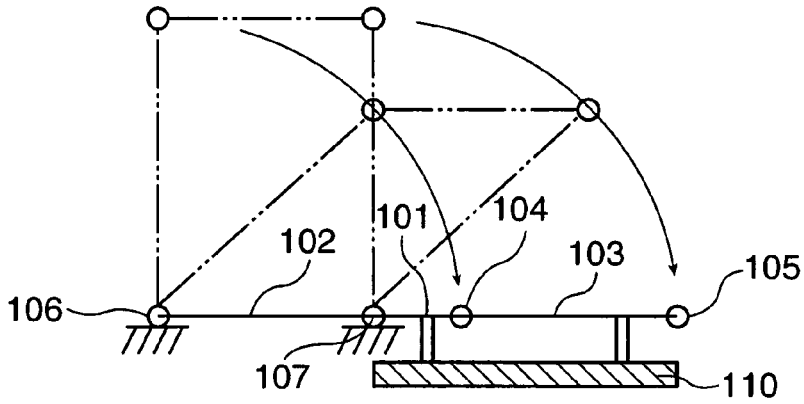
Figure 9C:
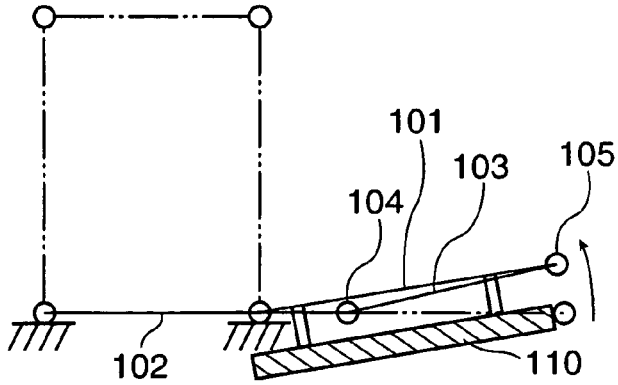

FIG. 4 and FIG. 5 are a side view and oblique view, respectively, of the cover opening and closing mechanism 30 for opening and closing the cover 5. FIG. 6 is a side view of the cover opening and closing mechanism 30 when the cover 5 is open approximately 45 degrees. FIG. 7 and FIG. 8 are side and oblique views, respectively, of the cover opening and closing mechanism 30 when the cover 5 is in the full open position.

The cover opening and closing mechanism 30 comprises a rocker panel 31 (first rocker link), right and left rocker arms 32, 33 (second rocker link) disposed behind the rocker panel 31, and a parallel motion panel 34 (parallel motion link), thus rendering a four-node parallel linkage mechanism.

The rocker panel 31 comprises a front panel portion 31*a* (connector portion) extending widthwise to the printer. The cover 5 is affixed to the front of this front panel portion 31*a*. Side panel portions 31*b*, 31*c* (rendering a pair of arms) bent at a right angle toward the back of the printer are formed at the right and left ends of the front panel portion 31*a*. The rocker panel 31 can swing in the front-to-back direction of the printer pivoting on support pins 35, 36 affixed to the bottom end portions of the right and left side panel portions 31*b*, 31*c*. The right and left rocker arms 32, 33 are located behind the right and left side panel portions 31*b*, 31*c* of the rocker panel 31, and the rocker arms 32, 33 can also pivot in the front-to-back direction of the printer on a support shaft 41 extending horizontally widthwise to the printer and attached to the bottom end portions of the rocker arms 32, 33.

The parallel motion panel 34 extends horizontally between the top end portions of the rocker panel 31 and the right and left rocker arms 32, 33. The parallel motion panel 34 comprises a horizontal plate 34*a* disposed horizontally widthwise to the printer, and right and left side panels 34*b*, 34*c* bent at a right angle upwards from the right and left ends of the horizontal plate 34*a*. Support shafts 42, 43 extending horizontally widthwise to the printer pass through the front and back ends of the right and left side panels 34*b*, 34*c*. The top end portions of the right and left side panel portions 31*b*, 31*c* of the rocker panel 31 are linked freely rotatably by the front support shaft 42, and the top end portions of the right and left rocker arms 32, 33 are linked freely rotatably by the back support shaft 43.

The platen guide 10 is disposed to the horizontal plate 34*a* of the parallel motion panel 34, and the first pressure roller 13 and second paper transportation roller 16 are disposed widthwise to the printer between the right and left side panels 34*b*, 34*c*. The paper discharge guide 3 is affixed to the front end part of the horizontal plate 34*a*.

The cover opening and closing mechanism 30 in this embodiment of the invention thus renders a four-node parallel linkage mechanism by means of rocker panel 31, right and left rocker arms 32, 33, and the parallel motion panel 34 linking the top ends of the rocker panel 31 and rocker arms 32, 33. This parallel linkage mechanism can open from the substantially upright closed position shown in FIG. 4 and FIG. 5 to the front of the printer to the substantially horizontal full open position shown in FIG. 7 and FIG. 8. Furthermore, because the parallel motion panel 34 moves while remaining in a horizontal position, the other members 3, 9, 10, 13, 16 disposed to the parallel motion panel 34 can move vertically while remaining in horizontal alignment.

The roll paper holder 8 of the roll paper compartment 6 can incline to the front of the printer pivoting on support shaft 41. A spring catch 44 is formed at a back end on the side of the roll paper holder 8, and another spring catch 46 is formed on the main printer frame 45 at a position below and to the back of spring catch 44. An extension spring (spring member) 47 is disposed between these spring catches 44, 46, and the roll paper holder 8 is held in the normal position open to the top (see FIG. 4) by means of this extension spring 47.

A protruding stop 48 projecting to the side is formed at the front right side of the roll paper holder 8. This stop 48 projects above the pivot path of the left rocker arm 33. When the cover 5 is closed, the stop 48 is positioned on the front inside of the side panel portion 31*c* of the rocker panel 31. When the cover 5 opens approximately 45 degrees from the closed position, the left rocker arm 33 falls forward and contacts the stop 48 as shown in FIG. 6. Thereafter, the left rocker arm 33 pushes against the stop 48 as the left rocker arm 33 swings forward. As a result, the roll paper holder 8 gradually tilts forward pivoting on the support shaft 41. When the cover 5 opens to the full open position, the roll paper holder 8 is inclined approximately 45 degrees as shown in FIG. 7 and FIG. 8. The left rocker arm 33 is also held with the force of the extension spring 47 pulling the rocker arm 33 upward pivoting on the bottom end of the rocker arm 33.

A rubber strip 49 (flexible member) of a predetermined thickness is affixed horizontally widthwise to the printer at the top end of the front panel portion 31*a* of the rocker panel 31 on the surface facing the back of the printer when the rocker panel 31 is in the closed position (see FIG. 2). When the cover 5 is in the full open position, the parallel motion panel 34 is on top of the front panel portion 31*a* of the rocker panel 31 with this rubber strip 49 therebetween as shown in FIG. 7. When the four-node parallel linkage mechanism is opened to the folded horizontal position, the nodes are positioned substantially in line with the rubber strip 49 disposed between the parallel motion panel 34 and rocker panel 31 in this embodiment of the invention, thus elevating the node (back support shaft 43) linking the tops of the parallel motion panel 34 and the right and left rocker arms 32, 33 behind the parallel motion panel 34 the thickness of the rubber strip 49.

When the cover opening and closing mechanism 30 thus comprised is opened forward to the horizontal position shown in FIG. 7 and FIG. 8, the rocker arm 33 is pulled to the back (in the cover 5 closing direction) pivoting on the bottom end node (support shaft 41) by the force of the extension spring 47. The parallel motion panel 34 is also pushed up by the elastic force of the rubber strip 49 disposed between the parallel motion panel 34 and rocker panel 31. As a result, the parallel motion panel 34 and rocker arms 32, 33 are prevented from bending down pivoting on the node (back support shaft 43) between them. The parallel linkage mechanism is therefore prevented from locking and preventing the cover 5 from opening.

As described above the cover opening and closing mechanism 30 in a roll paper printer 1 according to this embodiment of the invention comprises a four-node parallel linkage mechanism, and the parallel motion panel 34 and right and left rocker arms 32, 33 are urged by the tension of extension spring 47 and the elastic force of the rubber strip 49 so that they do not bend downward around the node (back support shaft 43) linking them. As a result, the cover opening and closing mechanism 30 will not lock when the cover 5 is closed from the full open position, and operation of the cover 5 is thus improved. Maintenance, including loading and replacing the paper roll 7, is also made easier in a roll paper printer 1 according to this embodiment of the invention because the roll paper holder 8 is inclined to the front in conjunction with opening the cover 5.

The roll paper printer 1 according to this embodiment of the invention uses both an extension spring 47 and rubber strip 49, but can be rendered using only one while still preventing the cover opening and closing mechanism 30 from locking and improving the operability of the cover 5. A porous synthetic rubber or plastic material can be used for the rubber strip 49.

Furthermore, the extension spring 47 urges the left rocker arm 33 in the closing direction indirectly by means of the stop 48 rendered to the roll paper holder 8 in the roll paper printer 1 according to this embodiment of the invention, but the extension spring 47 can be disposed to directly urge the left rocker arm 33.

An inkjet head is used as the print head in this roll paper printer 1, but the invention is not so limited and can be applied to roll paper printers using a thermal print head or other type of print head.

What is claimed is:

1. A roll paper printer comprising:

a roll paper compartment;

a cover for the roll paper compartment; and a cover opening and closing mechanism connected to the cover for opening and closing the cover;

wherein the cover opening and closing mechanism comprises a four-node parallel linkage mechanism including a plurality of links supported for pivotal movement about each of the four nodes in the four-node parallel linkage mechanism with at least two links adapted to rotatably swing in a direction to cause the four-node parallel linkage mechanism to fold into a full open position with the four nodes in substantial horizontal alignment or into a closed position for opening and closing the cover respectively, and a linkage urging member connected to at least one link for urging said parallel linkage mechanism toward the closed position such that the parallel linkage mechanism will not swing below a horizontal position where it may become locked into a fixed position when the parallel linkage mechanism is folded to the full open position from the closed position.

2. The printer of claim 1 wherein the plurality of links include side arms located on opposite sides of the printer each having upper and lower end portions with each two of the four nodes being located at each of the end portions in a spaced apart relationship and wherein the linkage urging member controls rotational pivoting of the side arms relative to a given one of the nodes at one or both of the end portions.

3. The printer of claim 1, wherein:

the parallel linkage mechanism comprises a first rocker link having arms on opposite sides of the printer with upper and lower end portions about which the first rocker link can pivot relative to the opening and closing direction of the cover;

a second rocker link; and a parallel motion link connecting the upper end portions of the first rocker link to the second rocker link, wherein the second rocker link is displaced from the first rocker link in a direction further from the cover; and wherein the linkage urging member is a spring member for urging the second rocker link toward the cover closing direction.

4. The printer of claim 3 wherein the second rocker link comprises opposing arms having upper and lower end portions with the opposing arms disposed on opposite sides of the printer displaced from the first rocker link and wherein the linkage urging member causes the arms to pivot on a node defining a pivot axis at a lower end portion of the second rocker link.

5. The printer of claim 4, wherein:

the roll paper compartment comprises a roll paper holder for holding roll paper;

the roll paper holder can incline in the opening direction of the cover;

the spring member is an extension spring constantly applying tension so that the roll paper holder does not incline; and an engaging portion formed to the roll paper holder so that the engaging portion engages the second rocker link after the second rocker link swings a predetermined distance in the cover opening direction; wherein upon engagement of the second rocker link to the engaging portion causes the urging force of the extension spring to act on the second rocker link whereby the roll paper holder is forced to incline in the cover opening direction in conjunction with the rocker link.

6. The printer of claim 3, wherein:

the linkage urging member further comprises an elastic member disposed between the first rocker link and the parallel motion link when the cover is opened to the full open position.

7. The printer of claim 1, wherein:

the parallel linkage mechanism comprises a first rocker link having arms on opposite sides of the printer with upper and lower end portions about which the first rocker link can pivot relative to the opening and closing direction of the cover;

a second rocker link; and a parallel motion link connecting the upper end portions of the first rocker link to the second rocker link, wherein the second rocker link is displaced from the first rocker link in a direction further from the cover; and wherein the linkage urging member is an elastic member that is disposed between the first rocker link and the parallel motion link when the cover is opened to the full open position.

8. The printer of claim 7, wherein:

the first rocker link further comprises a connecting member linking the arms disposed at opposite sides of the roll paper compartment; wherein the cover is affixed to one side of the connecting member in the cover opening direction, and the elastic member is disposed on another side of the connecting member facing the cover closing direction.

9. A roll paper printer comprising:

a roll paper compartment;

a cover for the roll paper compartment; and an cover opening and closing mechanism for opening and closing the cover;

wherein the cover opening and closing mechanism comprises a four-node parallel linkage mechanism including a plurality of links supported for pivotal movement about each of the four nodes in the four-node parallel linkage mechanism with at least two links adapted to rotatably swing in a direction to cause the four-node parallel linkage mechanism to fold into a full open position with the four nodes in substantial horizontal alignment or into a closed position for opening and closing the cover respectively, and a linkage urging member connected to at least one link for applying a directional force to urge the parallel linkage mechanism toward the closed position of the cover such that the links can only rotationally pivot in a given predetermined direction after the parallel linkage mechanism is folded to the full open position so that the parallel linkage mechanism will not swing below a horizontal position where it may become locked into a fixed position.

* * * * *